United States Patent [19]

Shaw

[11] 4,108,647

[45] Aug. 22, 1978

[54] ALLOYS OF NICKEL, CHROMIUM AND COBALT

[75] Inventor: Stuart Walter Ker Shaw, Sutton Coldfield, England

[73] Assignee: The International Nickel Company, Inc., New York, N.Y.

[21] Appl. No.: 703,563

[22] Filed: Jul. 8, 1976

[30] Foreign Application Priority Data

Jul. 17, 1975 [GB] United Kingdom ..... 30043/75

[51] Int. Cl.[2] ..... C22C 19/05

[52] U.S. Cl. ..... 75/171; 75/134 F; 148/32.5

[58] Field of Search ..... 75/171, 170, 134 F; 148/32, 32.5

[56] References Cited

U.S. PATENT DOCUMENTS 3,869,284 3/1975 Baldwin ..... 75/171

*Primary Examiner*—R. Dean

*Attorney, Agent, or Firm*—Ewan C. MacQueen; George N. Ziegler

[57] ABSTRACT

The high temperature properties of a nickel-base alloy containing correlated percentages of chromium, cobalt, tungsten, molybdenum, titanium, aluminium, carbon, tantalum, niobium, zirconium, hafnium, boron, yttrium and lanthanum are substantially maintainedor improved by further correlation of the percentages of chromium, carbon and boron in the alloy.

8 Claims, No Drawings

ALLOYS OF NICKEL, CHROMIUM AND COBALT

This invention relates to improved castable nickel-chromium-cobalt base alloys.

In the Specification of my Application No. 536,173 filed Dec. 24, 1974, (now U.S. Pat. No. 4,039,330) which is a continuation-in-part of Ser. No. 241 443 filed Apr. 5, 1972, abandoned I have described and claimed a nickel-base alloy adapted for use at elevated temperature and characterised by high stress-rupture strength and good corrosion resistance in sulphur- and chloride-containing environments while concomitantly exhibiting extended resistance to embrittlement for long periods upon prolonged exposure to temperatures at least as high as 870° C., said alloy having about 20% to 25% chromium, about 5% to 25% cobalt, up to 5% tungsten, up to 3.5% molybdenum, the tungsten and molybdenum being correlated such that the %W + 0.5 (%Mo) is from 0.5% to 5%, about 1.7% to 5% titanium and about 1% to 4% aluminium, the sum of the titanium and aluminium being about 4% to 6.5% with the ratio therebetween being from 0.75:1 to 4:1, from 0.02% to 0.25% carbon, from 0.5% to 3% tantalum, up to 3% niobium, 0.005% to 1% zirconium, and up to 2% hafnium, the value of %Zr + 0.5 (%Hf) being from about 0.01% to 1%, about 0.001% to 0.05% boron, up to about 0.2% in total of yttrium and/or lanthanum, and the balance being essentially nickel in an amount of at least 30%.

It is said that carbon contents below 0.02% lead to a reduction in stress-rupture strength, that the chromium content must be a minimum of about 20% for good corrosion resistance, and that amounts of boron in excess of 0.05% lead to inadequate impact resistance.

I have now found that provided the chromium content is a certain minimum, the carbon content can be reduced and/or the boron content can be increased, and yet the expected deterioration of high temperature properties is minimised or does not occur, and in some instances the properties may even be further improved.

Generally speaking and in accordance herewith, the present invention contemplates alloys having, by weight, about 5 to 25% cobalt, up to 3.5% molybdenum, up to 5% tungsten, the tungsten and molybdenum being correlated such that the %W + 0.5 (%Mo) is from 0.5 to 5, about 1.7 to 5% titanium and about 1 to 4% aluminum, the sum of the titanium and aluminum being about 4 to 6.5% with the ratio therebetween being from 0.75:1 to 4:1, from 0.5 to 3% tantalum, up to 3% niobium, 0.005 to 1% zirconium and up to 2% hafnium, the value of %Zr + 0.5 (%Hf) being from 0.01 to 1, up to about 0.2% in total of yttrium and/or lanthanum, and having chromium, carbon, and boron, the balance being essentially nickel in an amount of at least 30%, the improvement that the chromium content is at least 22 to 25% and the carbon and boron contents are such that when the carbon content is less than 0.02 down to 0.001% the boron content is in the range of from 0.001 to 1% and when the carbon content is in the range of from 0.02 to 0.25% the boron content is greater than 0.05 up to 1%.

All percentages and ratios in this specification are by weight.

The alloys must contain at least 22 up to 25% chromium and from 0.001 to 1% boron when the carbon content is less than 0.02 down to 0.001%, or from 0.05 up to 1% boron when the carbon content is in the range of from 0.02 to 0.25%, as outside these ranges the desired high temperature properties are impaired.

Preferably, if the carbon content is below 0.02%, the boron content is at least 0.05%, and advantageously at least 0.15%. Preferably, if the carbon content is above 0.02%, the carbon content is in the range of from 0.04 to 0.16% and the boron content is in the range of from 0.06 to 0.5%. An advantageous combination of properties is exhibited by a preferred group of alloys containing from 0.049 to 0.245% carbon, more than 22.0, preferably from 22.5, to 23.3% chromium, from 18 to 20% cobalt, preferably from 18.6 to 19.1% cobalt, from 1.87 to 2.21% tungsten, from 3.5 to 4.0, preferably from 3.63 to 3.80% titanium, from 1.7 to 2.3, preferably from 1.92 to 2.0% aluminium, from 1.2 to 1.6, preferably from 1.34 to 1.40% tantalum, from 0.8 to 1.2, preferably from 0.93 to 0.98% niobium, from 0.07 to 0.13, preferably from 0.10 to 0.11% zirconium, from 0.07 to 0.5% boron, balance nickel.

Even more advantageously the boron content should be in excess of 0.3% and a particularly advantageous combination of properties is exhibited by a preferred group of alloys containing from 0.01 to 0.02% carbon, from more than 22 to not more than 23% chromium, from 18.5 to 19.5% cobalt, from 1.5 to 2.5% tungsten, from 3 to 4% titanium, from 1.5 to 2.5% aluminium, from 1 to 2% tantalum, from 0.5 to 1.5% niobium, from 0.05 to 0.15% zirconium and from 0.3 to 0.85% boron, the balance, apart from impurities, being nickel. Preferably niobium is present in alloys of the invention in the range of from 0.2 to 3%.

To develop the full stress-rupture properties of the alloys of the present invention, they should be subjected to a heat treatment involving solution heating and subsequent ageing. Suitable heat treatments are those disclosed in the Specification of Application No. 536,173 with the modification that the solution heating treatment advantageously comprises heating for a time in the range of from 1 to 20 hours at a temperature in the range 1100° C to 1250° C and subsequent ageing for from 1 to 48 hours at a temperature in the range 600° to 950° C. A preferable heat treatment comprises solution heating at a temperature in the range 1,120° to 1200° C for a time in the range 2 to 16 hours, followed by heating at a temperature in the range 970° to 1030° C for a time in the range 2 to 10 hours, followed by heating at a temperature in the range 870° to 930° C for a time in the range 8 to 48 hours, then ageing at a temperature in the range 600° to 800° C for a time in the range 8 to 48 hours. A particularly advantageous heat treatment is to solution heat at 1150° C for 4 hours, air cool, heat at 1000° C for 6 hours, air cool, heat at 900° C for 24 hours, air cool, and finally age at 700° C for 16 hours and again air cool.

The stress-rupture properties exhibited by alloys of the present invention are illustrated in the following Example I.

EXAMPLE I

Alloys with compositions as shown in Table I were vacuum-melted and cast in vacuum to tapered test bar blanks, from which test pieces were machined. Prior to the machining of the test pieces, the blanks were heat treated by solution heating at 1150° C for 4 hours, air cooling, heating at 1000° C for 6 hours, air cooling, heating at 900° C for 24 hours, air cooling, and ageing at 700° C for 16 hours and air cooling. The heat treated test pieces were then subjected to various stress-rupture tests with the results shown in Table II. In Tables I and II, Alloys 1 to 9 are according to the present invention and Alloy A is a typical alloy according to claim 1 of Application No. 536173 for comparison purposes.

TABLE I

| | COMPOSITION WT % BALANCE Ni | | | | | | | | | |
|---|---|---|---|---|---|---|---|---|---|---|
| Alloy | Cr | Co | W | Nb | Ta | Ti | Al | Zr | C | B |
| 1 | 22.5 | 18.8 | 2.24 | 0.98 | 1.45 | 3.72 | 1.84 | 0.10 | 0.015 | 0.018 |
| 2 | 22.4 | 19.0 | 2.28 | 1.00 | 1.37 | 3.65 | 1.93 | 0.10 | 0.013 | 0.07 |
| 3 | 22.3 | 18.8 | 2.19 | 1.00 | 1.39 | 3.65 | 1.94 | 0.10 | 0.013 | 0.12 |
| 4 | 22.6 | 18.8 | 1.94 | 1.00 | 1.41 | 3.75 | 1.93 | 0.11 | 0.013 | 0.15 |
| 5 | 22.6 | 19.0 | 1.97 | 1.00 | 1.45 | 3.75 | 1.99 | 0.10 | 0.013 | 0.36 |
| 6 | 22.9 | 19.1 | 1.91 | 0.99 | 1.46 | 3.74 | 1.99 | 0.11 | 0.012 | 0.43 |
| 7 | 22.6 | 19.0 | 1.91 | 0.99 | 1.43 | 3.71 | 1.97 | 0.10 | 0.012 | 0.61 |
| 8 | 22.9 | 19.0 | 1.95 | 0.96 | 1.40 | 3.70 | 1.95 | 0.11 | 0.015 | 0.79 |
| A | 22.5 | 18.9 | 2.21 | 0.98 | 1.38 | 3.67 | 1.97 | 0.10 | 0.154 | 0.022 |
| 9 | 22.5 | 18.6 | 2.20 | 0.93 | 1.42 | 3.68 | 1.90 | 0.10 | 0.144 | 0.28 |

TABLE II

| | STRESS-RUPTURE | | | | | | | |
|---|---|---|---|---|---|---|---|---|
| | 600 N/mm²/732° C | | 550 N/mm²/760° C | | 330 N/mm²/816° C | | 120 N/mm²/927° C | |
| Alloy | Life (hours) | Elong.(%) | Life (hours) | Elong. (%) | Life (hours) | Elong.(%) | Life (hours) | Elong.(%) |
| 1 | 32 | 5.3 | 18 | 4.7 | 44 | 6.9 | 309 | 3.8 |
| | 27 | 4.6 | | | | | | |
| 2 | 32 | 5.4 | 22 | 3.2 | 83 | 4.1 | 294 | 2.2 |
| 3 | 90 | 5.9 | 34 | 8.2 | 149 | 5.4 | 566 | N.D.* |
| 4 | 158 | 12.1 | 95 | 10.5 | 454 | 4.3 | 503 | 8.2 |
| | 164 | 10.5 | | | | | | |
| 5 | 269 | 9.3 | 169 | 9.1 | 611 | 5.3 | 783 | 8.4 |
| 6 | 325 | 8.3 | 140 | 9.4 | 816 | 7.3 | 559 | 7.3 |
| 7 | 314 | 8.1 | 152 | 9.8 | 650 | 7.4 | 672 | 8.3 |
| 8 | 307 | 3.3 | 140 | 7.1 | 563 | 5.6 | 588 | 11.0 |
| A | 51 | 9.6 | 17 | 15.2 | 351 | 6.6 | 711 | 15.2 |
| 9 | 77 | 5.5 | 46 | 6.8 | 404 | 4.7 | 589 | 9.0 |

* N.D. - Not Determined.
N/mm² - Newtons per square millimeter.

It can be seen from Tables I and II that Alloy 1 with 0.015% carbon and 0.018% boron and Alloy 2 with 0.013% carbon and 0.07% boron had similar but slightly inferior stress-rupture life and elongation properties at 600 N/mm² and 732° C, at 330 N/mm² and 816° C, and at 120 N/mm² and 927° C to those of Alloy A, but had slightly better stress-rupture life properties at 550 N/mm² and 760° C. Alloys 3 and 4 with 0.013% carbon and with 0.12% and 0.15% boron, respectively, had, as can be seen from the results of Table II, better stress-rupture life properties at 600 N/mm² and 732° C, and at 550 N/mm² and 760° C than Alloy A, with similar elongation values, and stress-rupture life and elongation properties at 330 N/mm² and 816° C and at 120 N/mm² and 927° C similar to those of Alloy A. A comparison of the property values for Alloys 1 to 4 and A shows that for better properties alloys containing less than 0.02% carbon preferably should contain at least 0.05% boron and more preferably at least 0.1% boron.

The effect of increasing the boron content still further with alloys containing less than 0.02% carbon can be seen from the results for Alloys 4 to 8 in Table II.

The property improvements shown by Alloy 4 with 0.15% boron are even more marked with Alloys 5 to 8 which contained in excess of 0.3% boron. Thus, advantageously, alloys according to the invention containing less than 0.02% carbon should contain more than 0.3% boron. As can be seen from the results of Table II, Alloys 5 to 8 with more than 0.3% boron had better stress rupture life properties than Alloy A at 732° C, 760° C, 816° C and 927° C with similar ductility as shown by the elongation results.

Hence a preferred group of alloys according to the present invention contains from 0.01 to 0.02% carbon, from more than 22 to not more than 23% chromium, from 18.5 to 19.5% cobalt, from 1.5 to 2.5% tungsten, from 3 to 4% titanium, from 1.5 to 2.5% aluminium, from 1 to 2% tantalum, from 0.5 to 1.5% niobium, from 0.05 to 0.15% zirconium, from 0.3 to 0.85% boron, balance nickel.

The test results for Alloy 9 in Table II show that even with 0.144% carbon and a boron content of 0.28% better stress-rupture properties are obtained in comparison with Allloy A at 732° C, 760° C and 816° C with a slight fall off in properties at 927° C.

With the exception of Alloys 1 to 9 and the comparative Alloy A, Alloys 2 to 8 of Example I had carbon contents of less than 0.02% boron contents in excess of 0.05%. The following Example 2 illustrates properties illustrated by alloys of the invention having carbon contents in excess of 0.02% and boron contents in excess of 0.05%.

EXAMPLE 2

Alloys with compositions as shown in the following Table III were prepared as detailed in Example 1. In Table III Alloys 10 to 22 are according to the invention and Alloys A and B are typical alloys according to claim 1 of Application No. 536,173 for comparison purposes.

Test pieces from the Alloys of Table III were made and heat treated according to the procedure of Example 1 and then subjected to various stress-rupture tests with the results shown in Table IV and to impact resistance tests with the results shown in Table V.

TABLE III

| Alloy | Composition Wt % - Balance Ni | | | | | | | | | |
|---|---|---|---|---|---|---|---|---|---|---|
| | Cr | Co | W | Nb | Ta | Ti | Al | Zr | C | B |
| 10 | 22.8 | 18.8 | 1.88 | 0.96 | 1.38 | 3.77 | 1.92 | 0.11 | 0.051 | 0.15 |
| 11 | 22.8 | 19.0 | 1.90 | 0.96 | 1.35 | 3.81 | 1.96 | 0.11 | 0.051 | 0.28 |
| 12 | 23.0 | 19.0 | 1.93 | 0.97 | 1.37 | 3.79 | 1.99 | 0.11 | 0.049 | 0.50 |
| 13 | 22.5 | 18.8 | 1.89 | 0.95 | 1.36 | 3.80 | 1.93 | 0.11 | 0.073 | 0.07 |
| 14 | 22.7 | 18.6 | 2.03 | 0.96 | 1.34 | 3.74 | 1.94 | 0.10 | 0.087 | 0.16 |
| 15 | 23.0 | 18.8 | 1.96 | 0.98 | 1.37 | 3.63 | 1.98 | 0.11 | 0.100 | 0.44 |
| 16 | 22.8 | 18.8 | 1.91 | 0.93 | 1.38 | 3.68 | 1.98 | 0.11 | 0.150 | 0.07 |
| 17 | 22.7 | 18.7 | 1.87 | 0.95 | 1.40 | 3.70 | 1.98 | 0.11 | 0.146 | 0.13 |
| 18 | 22.7 | 18.9 | 1.96 | 0.95 | 1.37 | 3.73 | 1.99 | 0.10 | 0.154 | 0.27 |
| 19 | 23.1 | 19.1 | 1.88 | 0.95 | 1.36 | 3.70 | 2.00 | 0.10 | 0.146 | 0.42 |
| 20 | 22.8 | 18.8 | 1.97 | 0.94 | 1.37 | 3.68 | 2.00 | 0.10 | 0.245 | 0.14 |
| 21 | 23.2 | 18.9 | 1.93 | 0.97 | 1.39 | 3.65 | 1.96 | 0.10 | 0.24 | 0.27 |
| 22 | 23.3 | 19.0 | 1.91 | 0.94 | 1.36 | 3.68 | 1.97 | 0.11 | 0.24 | 0.46 |
| A | 22.5 | 18.9 | 2.21 | 0.98 | 1.38 | 3.67 | 1.97 | 0.10 | 0.154 | 0.022 |
| B | 22.8 | 18.7 | 1.87 | 0.95 | 1.36 | 3.76 | 1.93 | 0.11 | 0.109 | 0.015 |

TABLE IV

| Alloy | Stress-rupture | | | |
|---|---|---|---|---|
| | 550 N/mm²/760° C | | 330 N/mm²/816° C | |
| | Life (hours) | Elongation % | Life (hours) | Elongation % |
| 10 | 45 | 6.2 | 453 | 5.6 |
| 11 | 135 | 9.0 | 614 | 3.9 |
| 12 | 111 | 4.8 | 505 | 4.3 |
| 13 | 64 | 9.5 | 393 | 2.6 |
| 14 | 57 | 12.0 | 466 | 5.4 |
| 15 | 92 | 7.4 | 540 | 6.8 |
| 16 | 28 | 12.2 | 520 | 8.5 |
| 17 | 58 | 15.2 | 591 | N.D. |
| 18 | 90 | 11.5 | 541 | N.D. |
| 19 | 141 | 7.4 | 431 | 7.1 |
| 20 | 21 | 16.1 | 143 | 15.1 |
| 21 | 41 | 13.4 | 256 | 16.8 |
| 22 | 96 | 10.3 | 312 | 20.7 |
| A | 17 | 15.2 | 351 | 6.6 |

TABLE V

| Alloy | Impact Resistance at 20° C after 1000 hours at 816° C (Joules) | |
|---|---|---|
| 10 | 43 | 56 |
| 11 | 40 | 44 |
| 12 | 29 | 31 |
| 13 | 19 | 27 |
| 14 | 29 | 36 |
| 15 | 27 | 28 |
| 16 | 20 | 20 |
| 17 | 24 | 27 |
| 18 | 20 | 25 |
| 19 | 18 | 19 |
| 20 | 27 | 28 |
| 21 | 19 | 23 |
| 22 | 14 | 15 |
| B | 19 | 21 |

It can be seen from Tables III and IV that in all instances increasing the boron content above the 0.015% of comparison Alloy A for carbon contents between 0.049 and 0.245% resulted in improved stress-rupture life properties at 550 N/mm² and 760° C with the best improvement being achieved at boron contents in excess of 0.3%. Creep ductility properties at 550 N/mm² and 760° C are in many cases similar but in general slightly inferior to those of Alloy A when the boron content is increased above the 0.015% of Alloy A.

At 330 N/mm² and 816° C, with the exception of Alloys 20, 21 and 22 with carbon contents nominally of 0.24%, the stress rupture life properties are also improved in comparison with those of Alloy A for boron contents in excess of 0.015% for carbon contents between 0.049 and 0.154%. Again the creep ductility properties of Alloys 10 to 19 are similar to those of Alloy A and in the case of Alloys 20, 21 and 22 are better than those of Alloy A.

For an optimum balance of stress rupture life and creep ductility properties it is preferred that alloys according to the invention when containing more than 0.02% carbon should preferably contain carbon in the range of from 0.04 to 0.16% and boron in the range of from 0.06 to 0.5%. Advantageously the boron content should be in the range of from 0.3 to 0.5%.

A preferred group of alloys according to the invention contains from 0.049 to 0.245% carbon, more than 22.0, preferably from 22.5, to 23.3% chromium, from 18 to 20% cobalt, preferably from 18.6 to 19.1% cobalt, from 1.87 to 2.21% tungsten, from 3.5 to 4.0, preferably from 3.63 to 3.80% titanium, from 1.7 to 2.3, preferably from 1.92 to 2.0% aluminium, from 1.2 to 1.6, preferably from 1.34 to 1.40% tantalum, from 0.8 to 1.2, preferably from 0.93 to 0.98% niobium, from 0.07 to 0.13, preferably from 0.10 to 0.11% zirconium, from 0.07 to 0.5% boron, balance nickel.

Specimens 11.4 millimeter in diameter produced from the Alloys 10 to 22 and B, were Charpy impact tested after soaking for 1,000 hours at 816° C. As can be seen from Table III and V, apart from Alloy 22 containing 0.24% carbon and 0.46% boron, the specimens from the remaining Alloys 10 to 21 all had impact resistance properties, at least comparable to and in most cases better than those of the comparative Alloy B. For optimum impact resistance properties alloys according to the invention when containing more than 0.02% carbon should preferably contain carbon in the range of from 0.04 to 0.16% and boron in the range of from 0.06 to 0.50%. Excellent impact resistance properties were achieved with a boron content in the range of from 0.10 to 0.30% for a nominal carbon content of 0.05%.

Alloys according to the present invention when containing more than 0.3% boron would have a minimum stress-rupture life of 60 hours under a stress of 550 N/mm² at 760° C, a minimum stress-rupture life of 130 hours under a stress of 600 N/mm² at 732° C and a minimum stress-rupture life of 270 hours under a stress of 330 N/mm² at 816° C.

Alloys according to the invention are suitable for use in cast or wrought form in applications requiring a high level of stress rupture strength at high temperatures such as for gas turbine rotor blades.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and appended claims.

I claim:

1. In combination with a nickel-base alloy adapted for use at elevated temperature consisting essentially of, by weight, about 20% to 25% chromium, about 5% to 25% cobalt, up to 3.5% molybdenum, up to 5% tungsten, the tungsten and molybdenum being correlated such that the %W + 0.5(%Mo) is from 0.5% to 5%, about 1.7% to 5% titanium and about 1% to 4% aluminum, the sum of the titanium and aluminum being about 4% to 6.5% with the ratio therebetween being from 0.75:1 to 4:1, from 0.02% to 0.25% carbon, from 0.5% to 3% tantalum, up to 3% niobium, 0.005% to 1% zirconium and up to 2% hafnium, the value of % Zr + 0.5(%Hf) being from 0.01% to 1%, about 0.001% to 0.05% boron, up to about 0.2% in total of yttrium and/or lanthanum, and balance essentially nickel in an amount at least 30%, the improvement comprising a chromium content of more than 22% and carbon and boron contents in ranges of 0.001% to 0.25% carbon and 0.05% to 1% boron provided that when the carbon content is in the range of from 0.02% to 0.25%, the boron content is greater than 0.05% up to 1%.

2. An alloy in accordance with claim 1, containing at least 0.3% boron.

3. An alloy in accordance with claim 1, containing from more than 22 to not more than 23% chromium, from 18.5 to 19.5% cobalt, from 1.5 to 2.5% tungsten, from 3 to 4% titanium, from 1.5 to 2.5% aluminium, from 1 to 2% tantalum, from 0.5 to 1.5% niobium, from 0.05 to 0.15% zirconium, from 0.3 to 0.85% boron and from 0.01 to 0.02% carbon.

4. An alloy in accordance with claim 1, containing from 0.04 to 0.16% carbon and from 0.06 to 0.5% boron.

5. An alloy in accordance with claim 1, containing more than 22.0 up to 23.3% chromium, from 18 to 20% cobalt, from 1.87 to 2.21% tungsten, from 3.5 to 4.0% titanium, from 1.7 to 2.3% aluminium, from 1.2 to 1.6% tantalum, from 0.8 to 1.2% niobium, from 0.07 to 0.13% zirconium, from 0.07 to 0.5% boron and from 0.049 to 0.245% carbon.

6. An alloy in accordance with claim 1, containing from 22.5 to 23.3% chromium, from 18 to 20% cobalt, from 1.87 to 2.21% tungsten, from 3.63 to 3.80% titanium, from 1.92 to 2.0% aluminium, from 1.34 to 1.40% tantalum, from 0.93 to 0.98% niobium, from 0.10 to 0.11% zirconium, from 0.07 to 0.5% boron and from 0.049 to 0.245% carbon.

7. An alloy as set forth in claim 1 wherein the carbon content is below 0.02% and the boron content is at least 0.15%.

8. An alloy as set forth in claim 1 wherein the carbon content is below 0.02% and the boron content is 0.36% to 0.79%.

* * * * *